US011518957B2

(12) United States Patent
Faulk

(10) Patent No.: US 11,518,957 B2
(45) Date of Patent: Dec. 6, 2022

(54) ADDITIVE FOR MAGNETORHEOLOGICAL FLUIDS

(71) Applicant: LORD Corporation, Cary, NC (US)

(72) Inventor: Joseph Faulk, Raleigh, NC (US)

(73) Assignee: LORD Corporation, Cary, NC (US)

( * ) Notice: Subject to any disclaimer, the term of this patent is extended or adjusted under 35 U.S.C. 154(b) by 755 days.

(21) Appl. No.: 16/078,122

(22) PCT Filed: Feb. 28, 2017

(86) PCT No.: PCT/US2017/019853

§ 371 (c)(1),
(2) Date: Aug. 21, 2018

(87) PCT Pub. No.: WO2017/151562

PCT Pub. Date: Sep. 8, 2017

(65) Prior Publication Data

US 2021/0189285 A1 Jun. 24, 2021

Related U.S. Application Data

(60) Provisional application No. 62/407,569, filed on Oct. 13, 2016, provisional application No. 62/301,008, filed on Feb. 29, 2016.

(51) Int. Cl.
*C10M 171/00* (2006.01)
*C10M 105/36* (2006.01)
(Continued)

(52) U.S. Cl.
CPC ..... *C10M 171/001* (2013.01); *C10M 105/36* (2013.01); *C10M 107/02* (2013.01);
(Continued)

(58) Field of Classification Search
CPC ..... C10M 171/001; C10M 105/36; C10M 111/04; C10M 133/54; C10M 139/06;
(Continued)

(56) References Cited

U.S. PATENT DOCUMENTS 2,661,825 A 12/1953 Winslow
2,751,352 A 6/1956 Bondi
(Continued)

FOREIGN PATENT DOCUMENTS

CN 101070503 A 11/2007
DE 196 54 864 8/1997
(Continued)

OTHER PUBLICATIONS

Mason, Neil, Preparation and study of magnetic fluids, Durham E-Theses, Durham University, 275 pgs., Nov. 1986.
(Continued)

*Primary Examiner* — Cephia D Toomer
(74) *Attorney, Agent, or Firm* — Jenkins, Wilson, Taylor & Hunt, P.A.

(57) ABSTRACT

A magnetorheological fluid is provided having a reduced coefficient of friction and favorable settling characteristics. The fluid contains magnetically responsive particles, a carrier fluid, and an amine oleate salt.

18 Claims, 7 Drawing Sheets

(51) Int. Cl.

| | |
|---|---|
| ***C10M 107/02*** | (2006.01) |
| ***C10M 111/04*** | (2006.01) |
| ***C10M 125/22*** | (2006.01) |
| ***C10M 133/54*** | (2006.01) |
| ***C10M 137/00*** | (2006.01) |
| ***C10M 139/06*** | (2006.01) |
| ***C10M 141/12*** | (2006.01) |
| ***C10M 169/04*** | (2006.01) |
| ***H01F 1/44*** | (2006.01) |
| *C10N 40/14* | (2006.01) |
| *C10N 30/00* | (2006.01) |
| *C10N 20/06* | (2006.01) |
| *C10N 10/16* | (2006.01) |
| *C10N 10/14* | (2006.01) |

(52) U.S. Cl.

CPC ..... *C10M 111/04* (2013.01); *C10M 125/22* (2013.01); *C10M 133/54* (2013.01); *C10M 137/00* (2013.01); *C10M 139/06* (2013.01); *C10M 141/12* (2013.01); *C10M 169/04* (2013.01); *H01F 1/447* (2013.01); *C10M 2201/066* (2013.01); *C10M 2205/0206* (2013.01); *C10M 2207/2825* (2013.01); *C10M 2215/26* (2013.01); *C10M 2223/00* (2013.01); *C10M 2227/08* (2013.01); *C10N 2010/14* (2013.01); *C10N 2010/16* (2013.01); *C10N 2020/06* (2013.01); *C10N 2030/60* (2020.05); *C10N 2040/185* (2020.05)

(58) Field of Classification Search

CPC ..... C10M 137/00; C10M 125/22; C10M 141/12; C10M 169/04; C10M 107/02; C10M 2205/0206; C10M 2207/2825; C10M 2215/26; C10M 2227/08; C10M 2223/00; C10M 2201/066; H01F 1/447; C10N 2040/185; C10N 2030/60; C10N 2020/06

See application file for complete search history.

(56) References Cited

U.S. PATENT DOCUMENTS

| | | | | |
|---|---|---|---|---|
| 2,886,151 | A | | 5/1959 | Winslow |
| 4,944,802 | A | | 7/1990 | Chagnon et al. |
| 5,254,277 | A | | 10/1993 | Gentit et al. |
| 5,599,474 | A | | 2/1997 | Weiss et al. |
| 5,645,752 | A | | 7/1997 | Weiss et al. |
| 5,683,615 | A | * | 11/1997 | Munoz ..... H01F 1/447 252/62.52 |
| 5,705,085 | A | | 1/1998 | Munoz |
| 5,900,184 | A | | 5/1999 | Weiss et al. |
| 5,906,676 | A | | 5/1999 | Drummond |
| 6,074,365 | A | | 6/2000 | Hahndel et al. |
| 6,203,717 | B1 | | 3/2001 | Munoz et al. |
| 6,280,658 | B1 | | 8/2001 | Atarashi et al. |
| 6,395,193 | B1 | | 5/2002 | Kintz et al. |
| 6,547,983 | B2 | | 4/2003 | Iyengar |
| 6,547,986 | B1 | | 4/2003 | Kintz et al. |
| 6,592,772 | B2 | | 7/2003 | Foister et al. |
| 6,818,143 | B2 | | 11/2004 | Iyengar |
| 6,886,819 | B2 | | 5/2005 | Kintz et al. |
| 7,087,184 | B2 | | 8/2006 | Kintz et al. |
| 7,217,372 | B2 | | 5/2007 | Kintz et al. |
| 2002/0000533 | A1 | | 1/2002 | Iyengar et al. |
| 2002/0130305 | A1 | | 9/2002 | Iyengar et al. |
| 2003/0057395 | A1 | | 3/2003 | Iyengar et al. |
| 2003/0209687 | A1 | | 11/2003 | Iyengar |
| 2004/0084263 | A1 | | 5/2004 | Kintz et al. |
| 2005/0147974 | A1 | | 7/2005 | Muller-Shulte |
| 2005/0242321 | A1 | | 11/2005 | Iyengar et al. |
| 2009/0014681 | A1 | * | 1/2009 | Iyengar ..... H01F 1/447 252/62.54 |
| 2010/0155649 | A1 | | 6/2010 | Han et al. |
| 2010/0307601 | A1 | * | 12/2010 | Gabriel ..... B01F 5/0663 137/13 |
| 2018/0182521 | A1 | | 6/2018 | Komori et al. |

FOREIGN PATENT DOCUMENTS

| | | | | |
|---|---|---|---|---|
| GB | 1233658 | | * | 5/1971 |
| GB | 1233658 | A | | 5/1971 |
| JP | S 63175401 | A | | 7/1988 |
| JP | S63 278307 | | | 11/1988 |
| JP | S 63273304 | A | | 11/1988 |
| JP | S 63278307 | A | | 11/1988 |
| JP | H 03104806 | A | | 5/1991 |
| JP | H 0927414 | A | | 1/1997 |
| JP | H 10298574 | A | | 11/1998 |
| JP | H 115068575 | A | | 6/1999 |
| JP | 2001508939 | A | | 7/2001 |
| JP | 2006505957 | A | | 2/2006 |
| JP | 2007031629 | A | | 2/2007 |
| JP | 2008156624 | A | | 7/2008 |
| JP | 2010260977 | A | | 11/2010 |
| JP | 2012236943 | A | | 12/2012 |
| JP | 2013142182 | A | | 7/2013 |
| JP | 2014095031 | A | | 5/2014 |
| JP | 2014510824 | A | | 5/2014 |
| WO | 94/10691 | | | 5/1994 |
| WO | WO 2013/008836 | A1 | | 1/2013 |

OTHER PUBLICATIONS

Ayoub, N.Y., et al., A comparative magnetic study of the DC remanence for the frozen substituted Ba-hexaferrite ferrofluid and some conventional frozen ferrofluids, Journal of Magnetism and Magnetic Materials 201 (1999) 119-122.

Lambrick, D.B., et al., The Preparation of CO/Fe Alloy Fine Particles from HFeC03(CO)12, IEEE Transactions of Magnetics, vol. 24, No. 2, (Mar. 1, 1998) 1644-1646.

International Search Report for U.S. Appl. No. 16/078,122 dated May 26, 2017.

Chinese Office Action for U.S. Appl. No. 16/078,122 dated Jul. 26, 2019.

Chinese Office Action for U.S. Appl. No. 16/078,122 dated Jun. 28, 2020.

Japanese Search Report for U.S. Appl. No. 16/078,122 dated Aug. 13, 2020.

Japanese Office Action for U.S. Appl. No. 16/078,122 dated Sep. 10, 2020.

* cited by examiner

ADDITIVE FOR MAGNETORHEOLOGICAL FLUIDS

CROSS REFERENCE TO RELATED APPLICATIONS

The present application claims priority under 35 U.S.C. § 119(e) from U.S. Provisional Patent Application Ser. No. 62/301,008 filed Feb. 29, 2016, entitled "Additive for Magnetorheological Fluids", and U.S. Provisional Patent Application Ser. No. 62/407,569 filed Oct. 13, 2016, entitled "Additive for Magnetorheological Fluids", the disclosures of which are incorporated herein by reference.

FIELD OF THE INVENTION

The invention relates to magnetorheological fluid compositions that have reduced friction and improved low-temperature viscosity performance. More specifically, the present invention relates to magnetorheological fluid compositions containing an amine oleate salt additive, and optional molybdenum disulfide particles, which work in compliment with traditional magnetorheological fluid additives.

BACKGROUND OF THE INVENTION

Magnetorheological fluids are fluid compositions that undergo a change in apparent viscosity in the presence of a magnetic field. The fluids typically include ferromagnetic or paramagnetic particles dispersed in a carrier fluid. The particles become polarized in the presence of an applied magnetic field, and become organized into chains of particles within the fluid. The particle chains increase the apparent viscosity (flow resistance) of the fluid. The particles return to an unorganized state when the magnetic field is removed, which lowers the viscosity of the fluid.

Magnetorheological fluids have been proposed for controlling damping in various devices, such as dampers, shock absorbers, and elastomeric mounts. They have also been proposed for use in controlling pressure and/or torque in brakes, clutches, and valves. Magnetorheological fluids are considered superior to electrorheological fluids in many applications because they exhibit higher yield strengths and can create greater damping forces.

Magnetorheological fluids are distinguishable from colloidal magnetic fluids or ferrofluids. In colloidal magnetic fluids, the particle size is generally between 5 and 10 nanometers, whereas the particle size in magnetorheological fluids is typically greater than 0.1 micrometers, usually greater than 1.0 micrometers. Colloidal magnetic fluids tend not to develop particle structuring in the presence of a magnetic field, but rather, the fluid tends to flow toward the applied field.

Some of the first magnetorheological fluids, described, for example, in U.S. Pat. Nos. 2,575,360, 2,661,825, and 2,886,151, included reduced iron oxide powders and low viscosity oils. These mixtures tend to settle as a function of time, with the settling rate generally increasing as the temperature increases. One of the reasons why the particles tend to settle is the large difference in density between the oils (about 0.7-0.95 g/cm3) and the metal particles (about 7.86 g/cm3 for iron particles). The settling interferes with the magnetorheological activity of the material due to non-uniform particle distribution. Often, it requires a relatively high shear force to re-suspend the particles.

Various surfactants and suspension agents have been added to the fluids to keep the particles suspended in the carrier. Conventional surfactants include metallic soap-type surfactants such as lithium stearate and aluminum distearate. These surfactants typically include a small amount of water, which can limit the useful temperature range of the materials.

In addition to particle settling, another limitation of the fluids is that the particles tend to cause wear when they are in moving contact with the surfaces of various parts. Unfortunately, additives that lower friction in MR fluids tend to make settling worse, often resulting in a "hard-pack" of settled particles on the bottom of the chamber. It would be advantageous to have magnetorheological fluids that provide a better balance of low-friction characteristics and anti-settling properties. This would reduce wear when the fluid is moving contact with surfaces of various parts, and allow for easier re-dispersing with small shear forces after the magnetic-responsive particles settle. The present invention provides such fluids.

SUMMARY OF THE INVENTION

In a first embodiment of the present invention, a magnetorheological fluid is provided comprising magnetically responsive particles, a carrier fluid, and a friction reducing agent comprising an amine oleate salt. The amine oleate salt preferably comprises an amine salt of a carboxylic acid.

In another embodiment of the present invention, the amine portion of the amine oleate salt comprises the structure:

$$CR_3—(CR_2)_x—CR_3$$

preferably where at least two of the R groups are selected from $NH_2$ and $NHR^1$, and most preferably $R^1$ comprises a tallow alkyl. In a further embodiment of the present invention, the carboxylic acid comprises one carboxylic acid functionality and comprises about 10 to about 24 carbon atoms, and preferably about 16-18 carbon atoms. In a preferred embodiment of the present invention, the amine oleate salt comprises at least one of a diamine dioleate or a triamine dioleate, and most preferably wherein the amine oleate salt comprises N-(tallowalkyl)-1,3,-propanediamine dioleate. In another preferred embodiment of the present invention, the amine oleate salt is present in an amount from about 0.4 to 0.6 percent by weight based upon the total weight of the MR fluid.

In a further embodiment of the present invention, the fluid further comprises at least one of an organomolybdenum, a phosphorous-containing additive, or a sulfur-containing additive, preferably an organomolybdenum and a thiophosphorous compound. In a still further embodiment of the present invention, the carrier fluid comprises at least one of mineral oil, paraffin oil, cycloparrafin oil, and synthetic hydrocarbon oil, preferably a poly-α-olefin.

In another embodiment of the present invention, the fluid further comrises molybdenum disulfide with an average particle size of less than 2.0 microns, preferably about 1.5 microns or less.

In an additional embodiment of the present invention, the inventive fluid at −20° C. the viscosity is at least 75% less than the viscosity of an otherwise identical fluid without the amine oleate salt additive, wherein the viscosity is measured on an ARES-G2 rheomoeter with a 25 mm top plate and 40 mm bottom cup. Further, the coefficient of friction of this fluid is at least 50% of the coefficient of friction measured in an otherwise identical fluid without the amine oleate salt additive, wherein the coefficient of friction is measured on an ARES-G2 rheomoeter with a "ball on three ball" configuration.

Thus, there has been outlined, rather broadly, the more important features of the invention in order that the detailed description that follows may be better understood and in order that the present contribution to the art may be better appreciated. There are, obviously, additional features of the invention that will be described hereinafter and which will form the subject matter of the claims appended hereto. In this respect, before explaining several embodiments of the invention in detail, it is to be understood that the invention is not limited in its application to the details and construction and to the arrangement of the components set forth in the following description or illustrated in the drawings. The invention is capable of other embodiments and of being practiced and carried out in various ways.

It is also to be understood that the phraseology and terminology herein are for the purposes of description and should not be regarded as limiting in any respect. Those skilled in the art will appreciate the concepts upon which this disclosure is based and that it may readily be utilized as the basis for designating other structures, methods and systems for carrying out the several purposes of this development. It is important that the claims be regarded as including such equivalent constructions insofar as they do not depart from the spirit and scope of the present invention.

So that the manner in which the above-recited features, advantages and objects of the invention, as well as others which will become more apparent, are obtained and can be understood in detail, a more particular description of the invention briefly summarized above may be had by reference to the embodiment thereof which is illustrated in the appended drawings, which drawings form a part of the specification and wherein like characters of reference designate like parts throughout the several views. It is to be noted, however, that the appended drawings illustrate only preferred and alternative embodiments of the invention and are, therefore, not to be considered limiting of its scope, as the invention may admit to additional equally effective embodiments.

DETAILED DESCRIPTION

Figure 1:
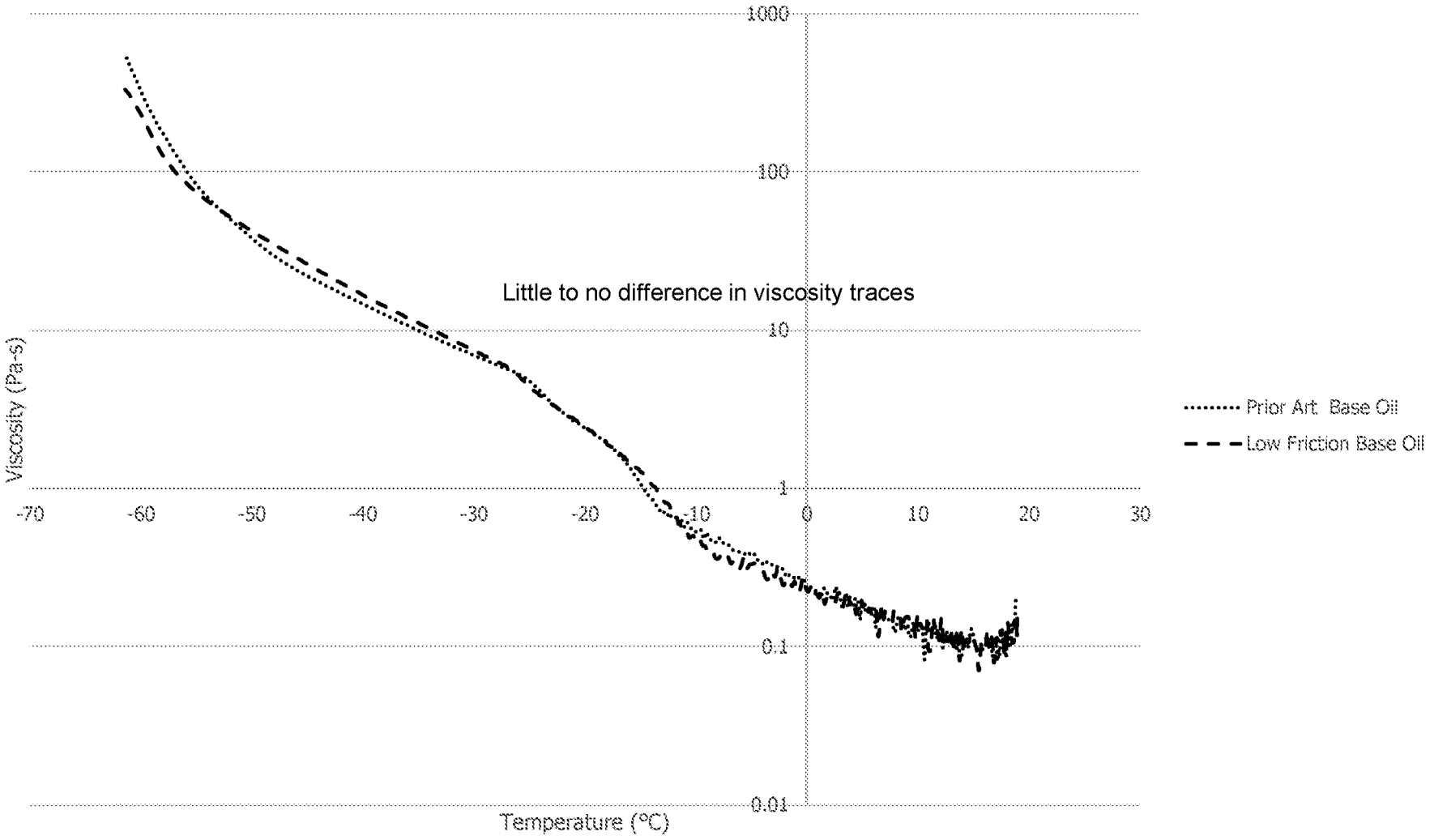
FIG. 1 is a chart of temperature vs. viscosity for a base oil with prior art additives and the additives in an embodiment of the present invention.

In one embodiment of the present invention, an MR fluid is provided comprising a carrier fluid, a magnetically responsive particle and an amine oleate salt as a friction reducing agent. In a further embodiment of the present invention other additives comprising at least one of an organoclay, organomolybdenum, ultrafine molybdenum disulfide, or thiophosphorous additive are provided.

In one embodiment of the present invention, the magnetically responsive particle comprises those known in the art. Any solid that is known to exhibit magnetorheological activity can be used, specifically including paramagnetic, superparamagnetic and ferromagnetic elements and compounds. Examples of suitable magnetizable particles include iron, iron alloys (such as those including aluminum, silicon, cobalt, nickel, vanadium, molybdenum, chromium, tungsten, manganese and/or copper), iron oxides (including $Fe_2O_3$ and $Fe_3O_4$), iron nitride, iron carbide, carbonyl iron, nickel, cobalt, chromium dioxide, stainless steel and silicon steel. Examples of suitable particles include straight iron powders, reduced iron powders, iron oxide powder/straight iron powder mixtures and iron oxide powder/reduced iron powder mixtures. A preferred magnetic-responsive particulate is carbonyl iron, preferably, reduced carbonyl iron.

The particle size should be selected so that it exhibits multi-domain characteristics when subjected to a magnetic field. Average particle diameter sizes for the magnetic-responsive particles are generally between 0.1 and 1000 μm, preferably between about 0.1 and 500 μm, and more preferably between about 1.0 and 10 μm, and are preferably present in an amount between about 5 and 50 percent by volume of the total.

In another embodiment of the present invention, the carrier fluids comprise any organic fluid, preferably a non-polar organic fluid, including those previously used by those of skill in the art for preparing magnetorheological fluids as described, for example. The carrier fluid forms the continuous phase of the magnetorheological fluid. Examples of suitable fluids include silicone oils, mineral oils, paraffin oils, silicone copolymers, white oils, hydraulic oils, transformer oils, halogenated organic liquids (such as chlorinated hydrocarbons, halogenated paraffins, perfluorinated polyethers and fluorinated hydrocarbons) diesters, polyoxyalkylenes, fluorinated silicones, cyanoalkyl siloxanes, glycols, and synthetic hydrocarbon oils (including both unsaturated and saturated). A mixture of these fluids may be used as the carrier component of the magnetorheological fluid. The preferred carrier fluid is non-volatile, non-polar and does not include any significant amount of water. Preferred carrier fluids are synthetic hydrocarbon oils, particularly those oils derived from high molecular weight alpha olefins of from 8 to 20 carbon atoms by acid catalyzed dimerization and by oligomerization using trialuminum alkyls as catalysts. Poly-α-olefin is a particularly preferred carrier fluid. Carrier fluids appropriate to the present invention may be prepared by methods well known in the art and many are commercially available, such as Durasyn PAO and Chevron Synfluid PAO.

Preferred PAO fluids exhibit a viscosity of from 1 to 50 centistokes, at 100° C., more preferably 1 to 10 centistokes.

In a further embodiment of the present invention, the PAO is used in mixture with known lubricant liquids such as liquid synthetic diesters. Examples of diester liquids include dioctyl sebacate (DOS) and alkyl esters of tall oil type fatty acids. Methyl esters and 2-ethyl hexyl esters have also been used. By virtue of their chemical make-up, the diester liquids are essentially polar.

In one embodiment of the present invention, the amine oleate salt preferably comprises an amine salt of a carboxylic acid. Often this salt is produced by reacting an amine with a carboxylic acid. The amine comprises at least one primary amino group. In a preferred embodiment of the present invention, the amine comprises more than one amino groups, preferably two. In a particularly useful embodiment, the amine has the following formula:

$$CR_3—(CR_2)_x—CR_3$$

wherein each R is independently selected from the group consisting of H, monovalent hydrocarbyl radicals and substituted counterparts thereof, $NH_2$ and $NHR^1$, with $R^1$ being selected from monovalent hydrocarbyl radicals and substituted counterparts thereof, provided that at least 1, and preferably 2 or more than 2, of the R groups is selected from $NH_2$ and $NHR^1$, and x is an integer in the range of 0 to about 10 or about 20 or more, more preferably in the range of 0 to 1 or 2 or about 3. Examples of monovalent hydrocarbyl radicals from which R and $R^1$ can be chosen include alkyl, alkenyl, aryl, aralkyl, aralkylene, alkaryl, aralkenyl, alkenaryl and substituted counterparts thereof. The monovalent hydrocarbyl radicals from which R and $R^1$ are selected are preferably aliphatic. Each such monovalent hydrocarby radical preferably has 1 to about 30 or more carbon atoms. Particularly useful examples of such monovalent hydrocarbyl radicals include ethyl, propyl, butyl, hexyl, octyl, decyl, dodecyl, tallowalkyl and the like radicals.

As used herein, the term "substituted counterpart" means any of the presently useful hydrocarbyl radicals, for example, included in the presently useful acid components and organic components, in which at least one of the H groups is replaced by a substituent group containing an element other than carbon and hydrogen, such as halogen, sulfur, oxygen, phosphorus, nitrogen and the like. Such substituent groups should be such as to not substantially interfere with the functioning, effectiveness and characteristics of the carrier fluid or other optional additives in the present invention.

A particularly useful amine is selected from a trimethylene diamine such as N-tallowalkyl trimethylene diamine, with tallowalkyl-amines being preferred to oleoalkyl amines.

Any of various carboxylic acid components can be used to form the presently useful organic component. Such components include the carboxylic acids themselves, acid salts of such carboxylic acids and mixtures thereof. Such carboxylic acids include at least one carboxylic acid functionality and preferably have 1 to about 30 carbon atoms, more preferably about 10 to about 24 or about 16-18 carbon atoms, per molecule. The carboxylic acid preferably is unsaturated, that is includes at least one carbon-carbon double bond. A particularly useful carboxylic acid from which the amine salt is derived is oleic acid.

Preferably, the amine salt is a poly salt, that is two or more of the H's bonded directly to amino nitrogen atom or atoms of the amine are reacted with carboxylic acid molecules. A very useful organic component is selected from N-(tallowalkyl)-1,3-propane diamine dioleates and mixtures thereof, such as the material sold by Akzo Nobel Chemicals Inc. under the trademark Duomeen TDO. Additional components comprise 1,3-propane diamine dioleates, such as the material sold by Akzo Nobel Chemicals Inc. under the trade name Armolube 211, or the triamine dioleates sold as Armolube 312. In a non-preferred embodiment of the present invention, a diamine monooleate salt is employed, such as Duomeen TMO (N-tallow trimethylene diamine monooleate).

In a further embodiment of the present invention, the MR fluid does not contain any ethoxylated amine materials as the friction reducing agent. Though ethoxylated amine materials have been used in prior art formulations, they are particularly ill suited for inclusion in the fluids of the present invention as they increase friction in the MR Fluid. In a preferred embodiment of the present invention, the MR fluid comprises essentially no ethoxylated amine, and most preferably is completely absent ethoxylated amine materials.

In one embodiment of the present invention, the amine oleate additive appears to have the largest influence on metal-to-metal, and metal-to-elastomer friction. Additionally, the amine oleate additive lowers the low-temperature viscosity of the MR fluid. In another embodiment of the present invention, these attributes are enhanced through the interaction between the amine oleate additive and other common MR fluid additives. Further, the amine oleate additive when added to an existing MR fluid blend creates a phase stable blend with other additives.

In a preferred embodiment of the present invention, the amine oleate additive is present in the MR fluid at less than about 1.0 weight percent, based on the total weight of the fully formulated MR fluid. In a more preferred embodiment of the present invention, the amine oleate additive is present in the MR fluid at about 0.4 to 0.6 weight percent, based on the total weight of the fully formulated MR fluid.

In one embodiment of the present invention, when added to a traditional MR fluid formulation the amine oleate additive complexes with the organomolybdenum and thiophosphate additives. In a preferred embodiment of the present invention, the traditional MR fluid comprises MRF-126CD, available from LORD Corporation, Cary, N.C. USA. Other appropriate fluids include MRF-132-DG and MRF-122EG, also available from LORD Corporation.

While not wishing to be bound by the theory, the inventor believes that the amine oleate additive is coating the iron particles and coordinating with the organomolybdenum and thiophosphorous additives, forming complexing with these additives. We hypothesize at low temperatures, the prior art systems form waxes and crystals resulting in increased viscosity of the fluid. The addition of the amine oleate additive appears to delay the formation of such waxes/crystals until lower temperatures are reached.

This is particularly advantageous in the low speed/low force regime, and appears to have utility in reducing low-temperature viscosity and low-temperature friction. For the purposes of this invention, low-temperature generally refers to temperatures less than 0° C., and particular temperatures from about −10° C. to about −50° C., with lower temperatures begin considered "ultra-low".

In one embodiment of the present invention, the fluid comprising the amine oleate additive is employed in an MR device comprising seals and an aperture for the passage of MR fluid from one chamber to another. Low temperatures are particularly hard on MR devices because as the temperature lowers, the viscosity of the fluid increases and the stress and friction on the device components increases.

In a further embodiment of the present invention, an anti-settling additive for MR fluid is provided comprising a micron or sub-micron sized molybdenum disulfide. A preferred MDS comprises a superfine MDS comprising an average particle size of about 1.5 microns. MDS powders can be purchased in a number of different grades corresponding to average particle size distribution from Rose Mill Co. LLC, Hartford, Conn., USA, or Climax Molybdenum, Phoenix, Ariz., USA.

The addition of superfine MDS improves settling characteristics as evidenced by a lower sediment hardness within the solids layer after a prescribed settling period. This is also known as "soft settling". In a preferred embodiment of the present invention, the MDS powder is present in the final MR fluid formulation at about 1.0 to about 7.0 weight percent, preferably about 2.5 to 4.5 weight percent, and more preferably about 3.5 weight percent, based on the total weight of the composition.

While not wishing to be bound by the theory, the inventor believes that the superfine MDS is able to pack between the carbonyl iron particles to inhibit settling.

In one embodiment of the present invention, the addition of MDS also allows for the discontinuation of traditional organomolybdenum additives, which are commonly used in MR fluids. It appears that the removal of organomolybdenum additives further improves the settling performance of the MR fluid.

In another embodiment of the present invention, organoclays are used in the fluid compositions described herein as anti-settling agents, thickening agents and rheology modifiers. They increase the viscosity and yield stress of the magnetorheological fluid compositions described herein. The organoclays are typically present in concentrations of between about 0.1 to 6.5, preferably 3 to 6 weight percent, based on the weight of the total composition.

The hydrophobic organoclay provides for a soft sediment once the magnetic-responsive particles settle out. The soft sediment provides for ease of re-dispersion. Suitable clays are thermally, mechanically and chemically stable and have a hardness less than that of conventionally used anti-settling agents such as silica or silicon dioxide.

In further embodiments of the present invention, additional anti-friction, anti-wear, extreme-pressure, and anti-oxidant additives may optionally be included. Other suitable MR fluid systems and additives include those discussed in U.S. Pat. Nos. 7,217,372; 6,203,717; 5,906,676; 5,705,085; and 5,683,615 all hereby incorporated by reference in full.

Examples optional additives that provide antioxidant function include zinc dithiophosphates, hindered phenols, aromatic amines, and sulfurized phenols. Examples of lubricants include organic fatty acids and amides, lard oil, and high molecular weight organophosphorus compounds, phosphoric acid esters. Example synthetic viscosity modifiers include polymers and copolymers of olefins, methacrylates, dienes or alkylated styrenes. In addition, other optional additives providing a steric stabilizing function include fluoroaliphatic polymeric esters, and compounds providing chemical coupling include organotitanate, -aluminates, -silicone, and -zirconates coupling agents.

One of skill in the art can readily select optional additive components as desired in a particular formulation. The amount of optional components typically each can range from about 0.25 to about 12 volume percent, based on the total volume of the magnetorheological fluid. Preferably, the optional ingredients each will be present in the range of about 0.5 to about 7.5 volume percent based on the total volume of the magnetorheological fluid.

The fluids of the invention can be made by any of a variety of conventional mixing methods. If the organoclay is not self-activating, an activator can be added to help disperse the clay. Preferred activators include propylene carbonate, methanol, acetone and water. The maximum product viscosity indicates full dispersion and activation of the clay. Enhancement of the settling stability can be evaluated using a settling test. In one embodiment, the clay is mixed with the carrier fluid and a polar activator to form a pre-gel before the magnetic-responsive particles are added.

The hardness of any settlement on the bottom of the composition can be measured using a universal testing machine (which pushes or pulls a probe and measures the load), for example, an Instron, in which a probe attached to a transducer is pushed into the sediment cake and the resistance measured. In addition, a re-dispersion test can be performed, where the mixture is re-agitated and the ability of the composition to form a uniform dispersion is measured by visual inspection or the hardness test.

Although the present invention has been described with reference to particular embodiments, it should be recognized that these embodiments are merely illustrative of the principles of the present invention. Those of ordinary skill in the art will appreciate that the compositions, apparatus and methods of the present invention may be constructed and implemented in other ways and embodiments. Accordingly, the description herein should not be read as limiting the present invention, as other embodiments also fall within the scope of the present invention as defined by the appended claims.

EXAMPLES

Example 1—Effect of Amine Oleate Salt in MR Fluids

Preparation of Fluid:

In these examples, MR fluids were prepared by mixing the polyalphaolefin/dioctyl sebacate (PAO/DOS) carrier fluid, Duomeen TDO friction reducing agent, and the organomolybdenum and thiophosphorous additives under agitation for about 10-15 minutes at 40-50° C.

Once the additives are sufficiently incorporated into the carrier fluid, the organoclay is added and the mixture is mixed for about 15 minutes with a disperser blade. The carbonyl iron is then added to the system a little bit at a time until it wets and is incorporated. The entire mixture is then ground for an additional 15 minutes. The final MR fluid comprises a solids concentration of about 26 volume percent and about 0.58 weight percent Duomeen TDO.

Viscosity Testing:

All tests were performed using an ARES-G2 rheometer fitted with parallel plate geometry. The environmental chamber was fitted with liquid nitrogen and the samples were cooled at 10° C./min from 23° C. to −60° C. and samples were measured at a rate of 1 point per second.

For the examples testing liquids only, a 40 mm top plate was used with a 40 mm cup on bottom. For the examples testing liquids with clay/iron, a 25 mm top plate was employed with the 40 mm bottom cup.

FIG. 1 provides a plot of the Base Oil (carrier fluid) with the additives, but excluding clay and iron. The current prior art fluid (Production Base Oil) is compared to the fluid of an embodiment of the present invention, comprising the Production Base Oil with the amine oleate salt additive (Low Friction Base Oil). The viscous profile is predominately driven by base oil components only, with 84% by weight being PAO and DOS. The addition of the amine oleate salt additive does not appear to have any effect on the system even in combination with the other additives, but absent the clay and iron particles.

Figure 2:
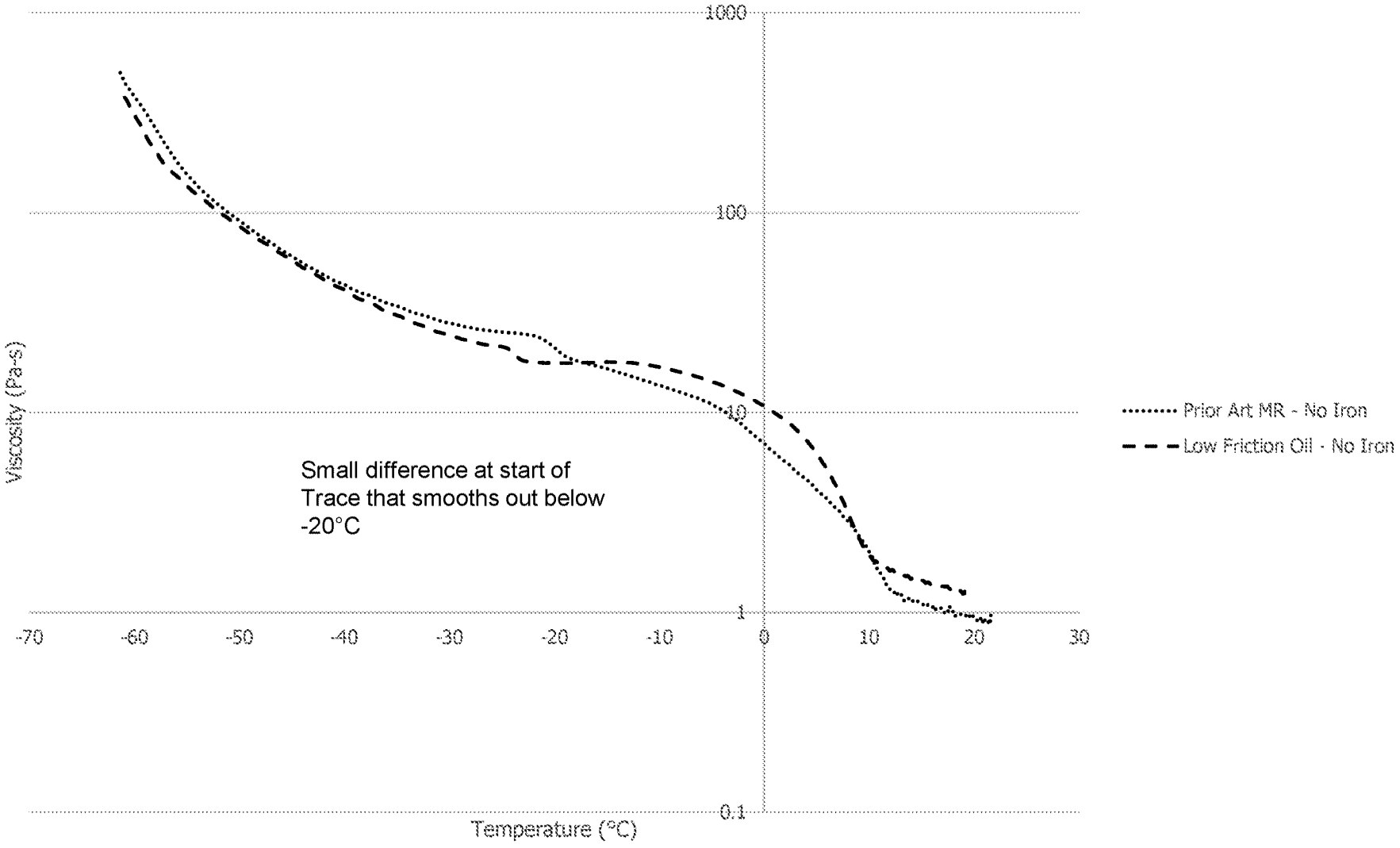
FIG. 2 is a chart of temperature vs. viscosity for a base oil with prior art additives and clay and the additives and clay of an embodiment of the present invention.

FIG. 2 provides a plot of the Base Oil with the additives and clay, but excluding the iron particles. There is a small difference at start of the trace that smooths out below about −20° C. As such, even with the addition of clay, there does not appear to be much of a change in the viscosity profile between the prior art fluid and the fluid containing the additive of an embodiment of the present invention.

Figure 3:
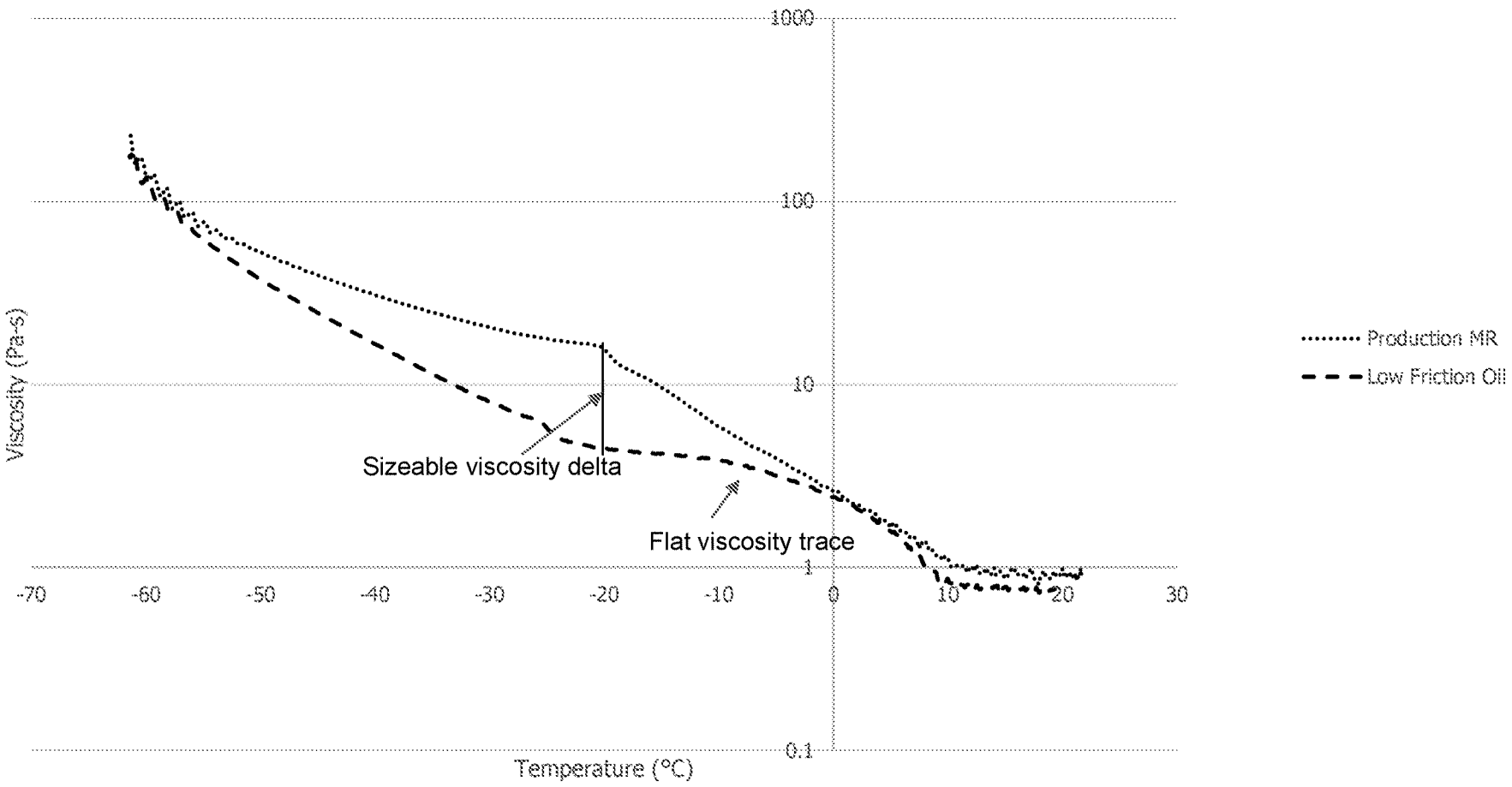
FIG. 3 is a chart of temperature vs. viscosity for a fully formulated prior art MR fluid and an MR fluid in an embodiment of the present invention.

FIG. 3 provides a plot of a Prior Art fully formulated MR Fluid and the same fluid with the amine oleate salt additive. There is a sizeable viscosity difference, particularly at low temperatures, when iron powder is added. Though there is an effect on low temperature viscosity, the viscosity from about 0° C. to room temperature appears to be unaffected.

As the system get cooler from about 0° C., the effect is more noticeable. We hypothesize that the iron particles are coated with the amine oleate salt additive and in coordination with the other additives in the system, the MR fluid is kept from crystalizing thereby keeping the viscosity lower.

Additionally, tests were performed with different base oils and carbonyl iron from different suppliers and no difference in viscosity was noted. As such, it appears the effect of including an amine oleate salt additive to a traditional MR fluid is effective even for different base oils and different carbonyl irons.

Friction Testing:

While the reduction in viscosity as demonstrated above is impressive, to reduce device wear and increase the life of the MR system (fluid and device) a reduction of friction between the MR fluid and the device components is desired. The coefficient of friction was measured between the MR fluid and stainless steel balls to simulate movement between a piston and a cylinder ("metal to metal"), and between the MR fluid and a urethane ring to simulate movement between a shaft and seals ("metal to elastomer"). The boundary friction, i.e. startup and low speed friction, was measured.

Friction data was generated in the ARES-G2 rheometer with a "ring on plate" configuration for metal to elastomer friction and "ball on 3 ball" configuration for metal to metal friction. The samples were allowed a 5 minute "wear in" to allow the surface active components of the fluid to fully coat the surfaces of the test equipment. The test then began at very low speeds and measurements were taken as indicated in Tables 4 and 5.

The results for MR fluid to metal friction is presented in Table 1, demonstrating a greater than 30% friction reduction. The results for MR fluid to elastomer friction is presented in Table 1 demonstrating a greater than 22% friction reduction.

TABLE 1

Friction Results

| | Prior Art Fluid | Inventive '786 MR Fluid |
|---|---|---|
| Metal-Metal Friction | 0.057 | 0.039 |
| Metal-Elastomer Friction | 0.235 | 0.182 |

Example 2—Effect of Ultrafine Molybdenum Disulfide

Additives for magneto-rheological (MR) fluids that provide improved friction performance often cause an increase in fluid clear layer over time. This is due to the decreased inter-fluid frication allowing the solids to settle to the bottom of the fluid chamber when the fluid is not being used. As the particles settle into a dense bottom layer, a clear top layer becomes visible. As such, measurement of this clear layer is one means for determining the effectiveness of anti-settling agents in an MR fluid. Another indication is measurement of the viscosity at certain points throughout the column of MR fluid.

Preparation of Fluid:

In these examples, MR fluids were prepared by mixing the polyalphaolefin/dioctyl sebacate (PAO/DOS) carrier fluid, about 0.6 weight percent Duomeen TDO, and about 3.6 weight percent molybdenum disulfide (when employed) and other additives under agitation for about 10-15 minutes at 40-50° C.

Once the additives are sufficiently incorporated into the carrier fluid, the organoclay is added and the mixture is mixed for about 15 minutes with a disperser blade. The carbonyl iron is then added to the system a little bit at a time until it wets and is incorporated. The entire mixture is then ground for an additional 15 minutes. The final MR fluid comprises a solids concentration of about 26 volume percent.

Sample Preparation:

A pint can was filed with 400 ml of fluid (Weight=400 ml×Density (g/mL)), and placed into a thermal cycling chamber. The sample was then heated according to the following procedure:

Heat sample to 125° C.
Cycle from 125° C. to −20° C. for one hour
Hold sample for two hours
Cycle back to 125° C.
Hold sample for 8 hours
Cycle from 125° C. to −20° C. for one hour
Hold sample for two hours
Cycle back to 125° C.
Hold sample for 8 hours This procedure was repeated for one week, then the sample was removed at the beginning of day 7 and allowed to cool to room temperature. The clear layer and sediment hardness were then measured according to the following procedure.

The distance from the top of the pint can to top of fluid was measured. Then the top of the fluid to the top of the sediment was measured to determine the height of the clear layer. Then the following equation is used to calculate clear layer percentage:

$$\% \text{ CL} = \text{Clear Layer (mm)}/(\text{Height of Can (mm)} - \text{Top to Fluid (mm)}) \times 100$$

To measure sediment hardness, we used a Texture analyzer in compression mode. Using a load cell and a penetration probe, the sample is penetrated at a very constant rate of 2.63 mm/s through the entire sediment layer. The readings remain at 0N through the top of the fluid layer as this "clear layer" contains very little or no particulate matter to hinder the probe. Once the probe reaches the "sediment layer" the readings become non-zero and the sediment hardness in Newtons is measured until the probe reaches the bottom of the can at roughly 100 mm. Table 2 summarizes the viscosity, clear layer % and the maximum sediment hardness, while the figures demonstrate the sediment hardness as a function of distance through the sample.

TABLE 2

| | Low Friction | LF w/o Moly | LF + MDS + Moly | LF + MDS − Moly |
|---|---|---|---|---|
| Viscosity | 48.33 cps | 47.0 cps | 59.1 cps | 57.98 cps |
| Clear Layer | 45.34% | 41.45% | 34.97% | 38.86% |
| Sediment Hardness | 1.01 | 1.15 | 0.92 | 1.24 |

Figure 4:
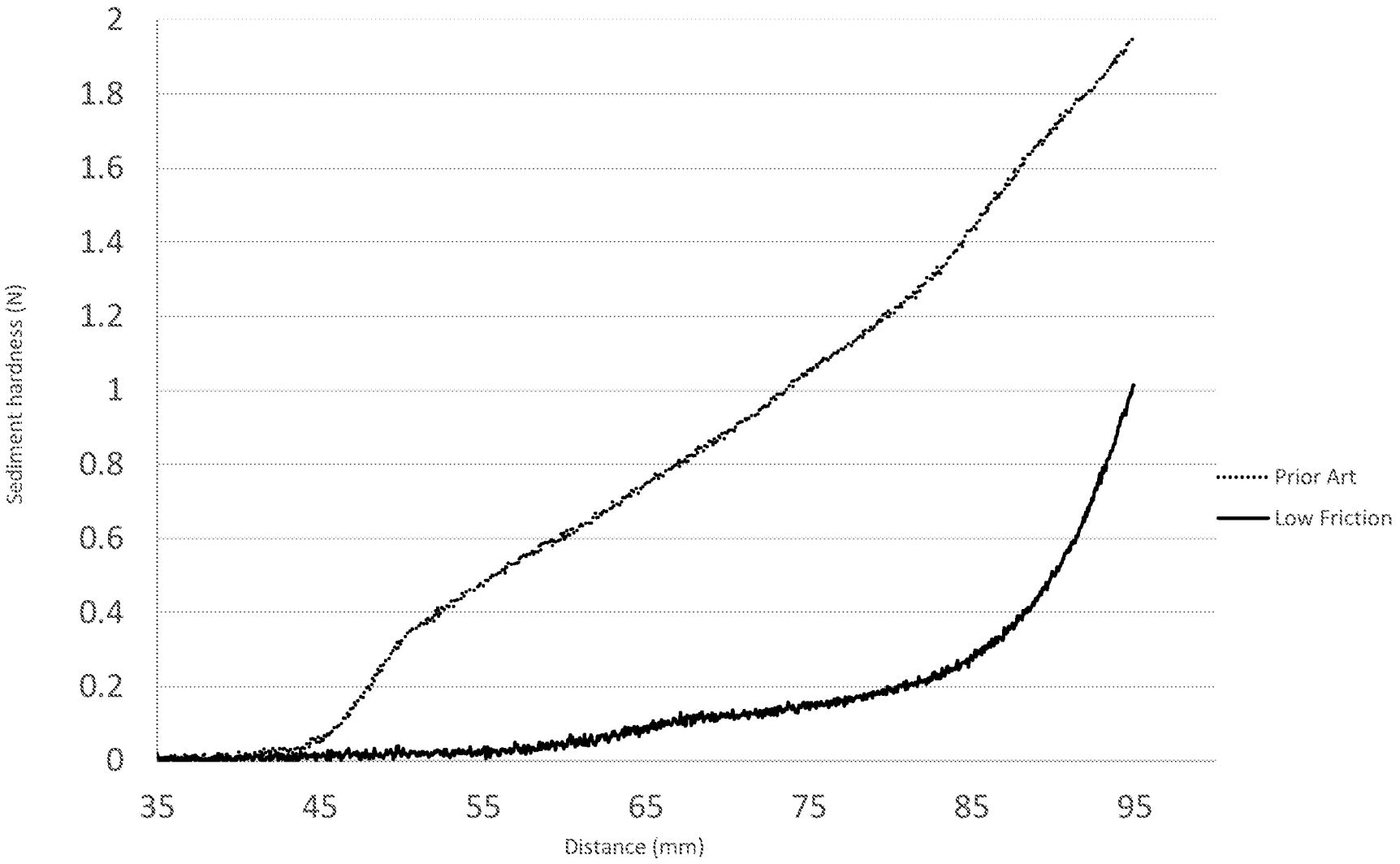
FIG. 4 is a chart of distance vs. sediment hardness for a Prior Art MR fluid and two fluids according to embodiments of the present invention.
Figure 5:
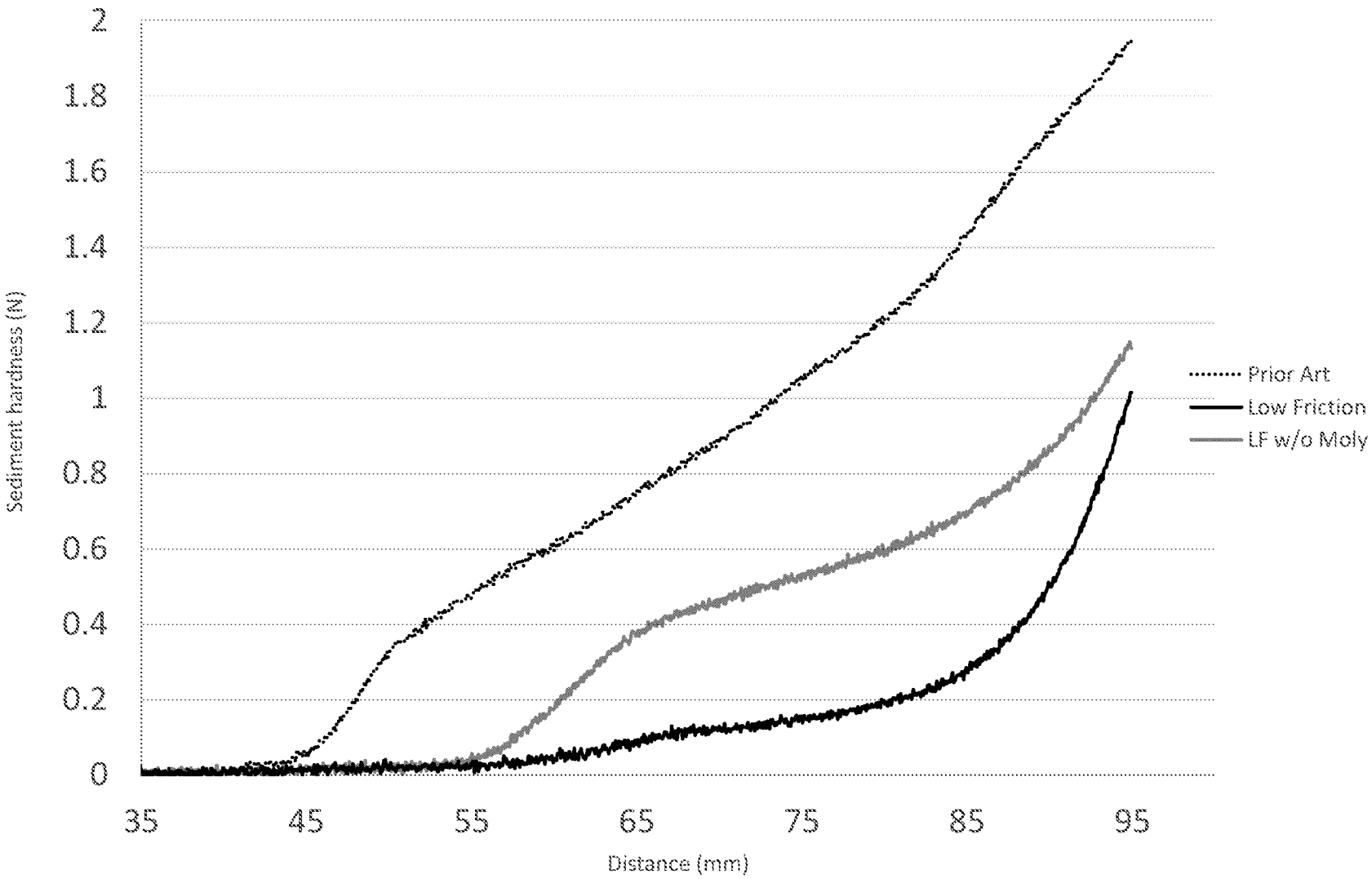
FIG. 5 is a chart of distance vs. sediment hardness for a Prior Art MR fluid and a fluid according to an embodiment of the present invention.

FIG. 4 provides a plot of a current commercially produced MR fluid (Prior Art) as compared to a fluid of an embodiment of the present invention ("Low Friction"). This fluid comprises a PAO/DOS carrier, carbonyl iron particles, a traditional organomolybdenum additive (Molyvan 855), and an amine oleate salt, but without any additional anti-settling materials added. Although the Low Friction fluid has better friction characteristics than the Prior Art fluid, its settling performance is poor. The Prior Art fluid presents a linear sediment hardness profile which indicates a uniform density/settling of the particles. The dramatically curved profile of the Low Friction fluid indicates a hard settling with most of the particles settled in to a dense layer at the bottom of the can. This is evidenced by the dramatic slope of the curve after about 85 mm. That said, the maximum sediment hardness of about 1.0N was almost half of the almost 2.0N demonstrated by the Prior Art fluid FIG. 5 provides a plot of the Prior Art fluid as compared to the Low Friction fluid of FIG. 4, as well as the Low Friction fluid with the traditional organomolybdenum additive removed ("LF w/o Moly"). With the additive removed, there was much better settling performance, with the sediment hardness taking on a more linear profile. Further, the maximum sediment hardness of the LF w/o Moly fluid is about 1.15, still almost half that of the Prior Art fluid.

Figure 6:
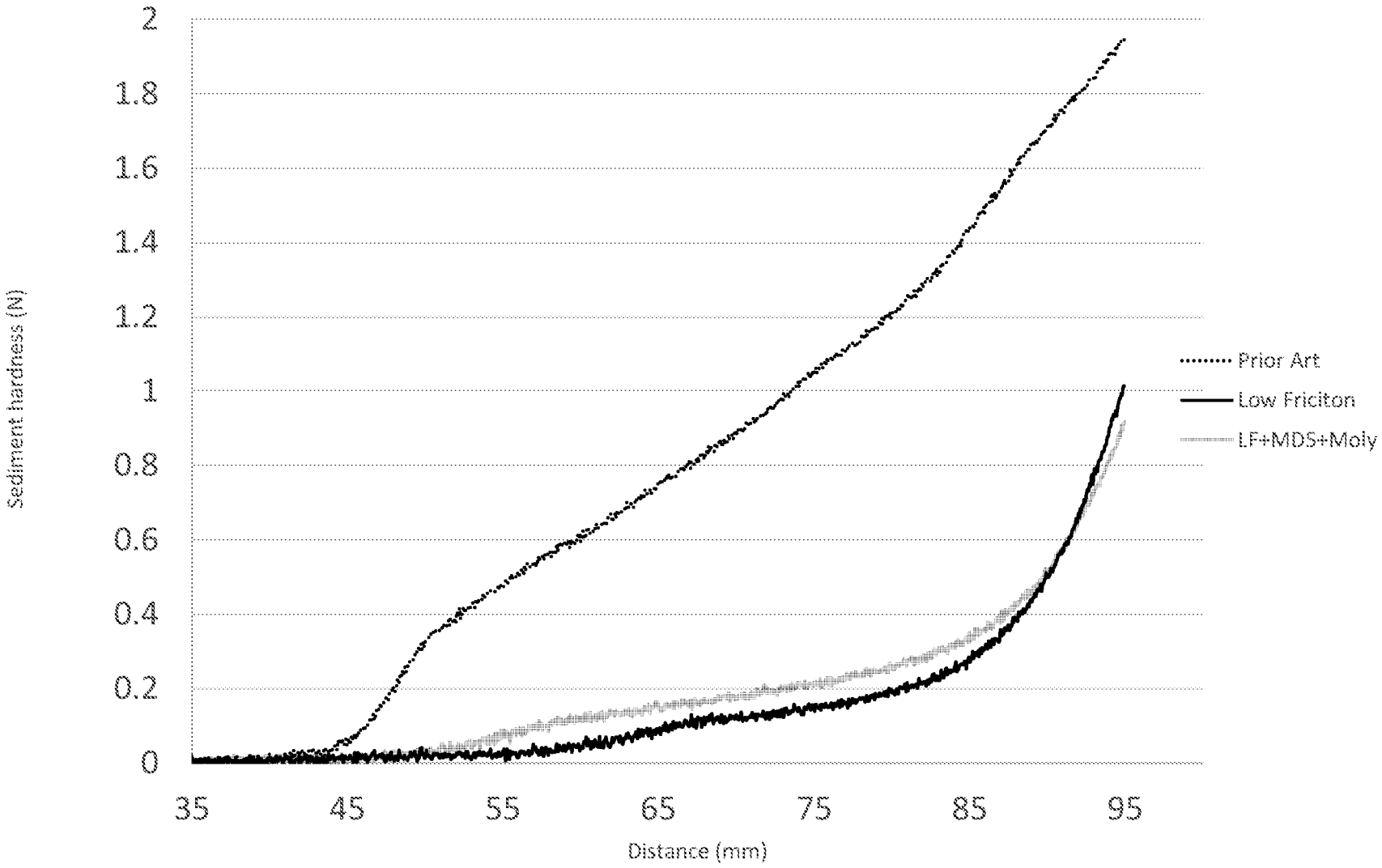
FIG. 6 is a chart of distance vs. sediment hardness for a Prior Art MR fluid and a fluid according to an embodiment of the present invention.
Figure 7:
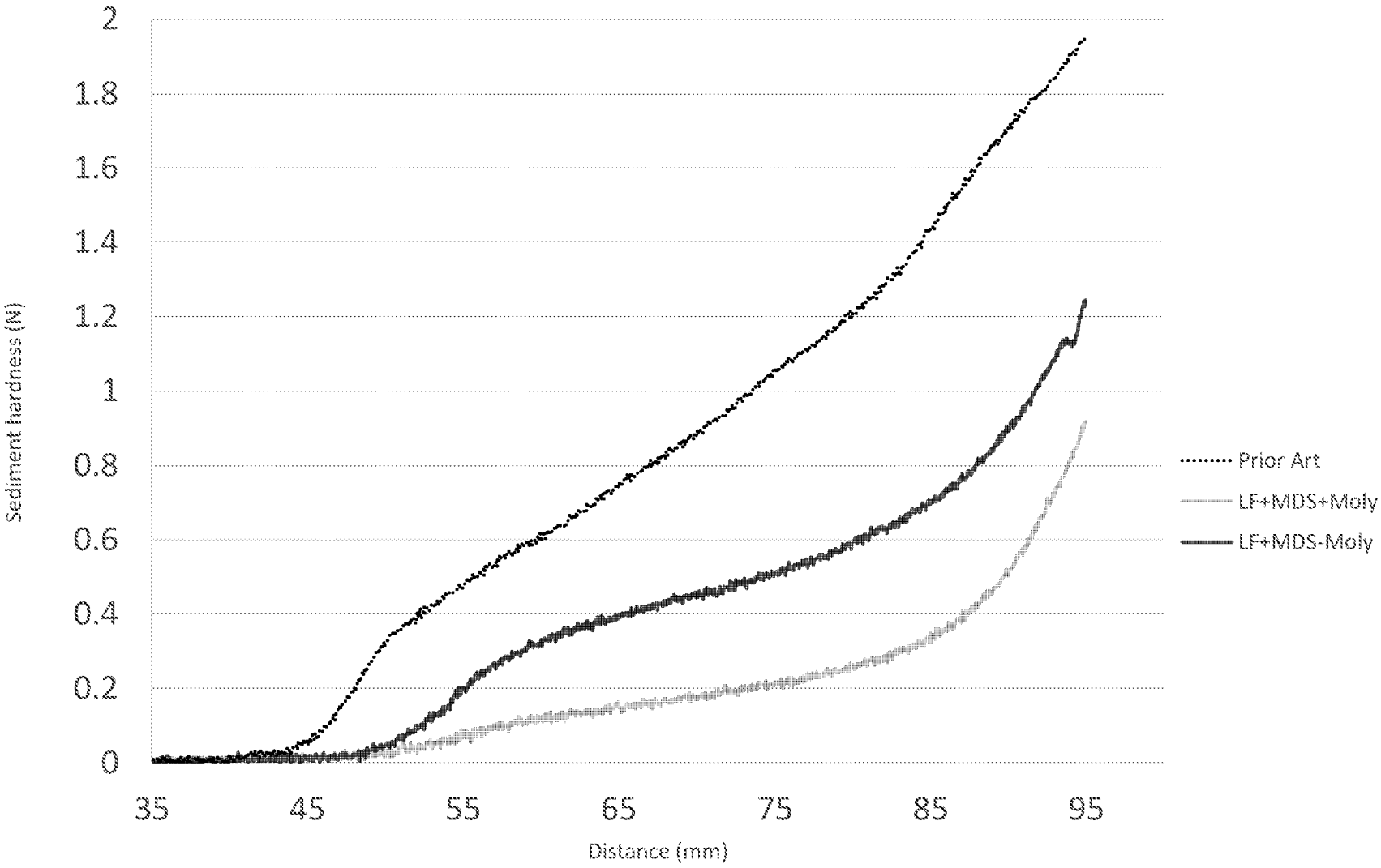
FIG. 7 is a chart of distance vs. sediment hardness for a Prior Art MR fluid and a fluid according to an embodiment of the present invention.

FIG. 6 provides a plot of the Prior Art fluid as compared to the Low Friction fluid as well as the Low Friction fluid with the addition of 1.5 micron sized molybdenum disulfide ("LF+MDS+Moly"). With the addition of MDS powder, settling is improved as illustrated by a more even (linear) harness profile, though there is still a notable increase in the last 15 mm or so. Maximum hardness dropped a little to about 0.9N FIG. 7 provides a plot of the Prior Art fluid as compared to the fluid of FIG. 6 containing MDS and the traditional organomolybdenum additive, as well as a fluid containing the amine oleate salt and superfine MDS, but without the traditional organomolybdenum additive ("LF+MDS-Moly"). With the MDS added and the organomolybdenum removed, the settling has improved as evidenced by the more linear harness profile, particularly toward the bottom of the can. As such, the most preferred fluid contains an amine oleate salt and MDS which reduces friction and also assists with the settling profile, particularly when the organomolybdenum is removed.

Example 3—Alternate Amine Materials

Two base fluids were prepared in accordance with the present invention, the first fluid "787 Fluid" comprising a PAO2.5/DOS base fluid and Molyvan 855, and the second fluid "690 Fluid" without the Molyvan 855, but with 3.6 weight percent superfine MDS powder. Various amine additives were included at about 0.6 weight percent and friction and viscosity at certain temperature were measured. The following additives were evaluated: Tertrameen T (a linear tetraamine); Triameen T (a linear triamine); Duomeen T (a linear diamine); the Armolube 312, Duomeen TDO, and Armolube 211 (amine oleate salts described herein); and Ethomeen T15 (an ethoxylated amine).

As demonstrated in Tables 2 and 3 below, the amine oelate salts of the present invention demonstrated the lowest friction and viscosity, particularly as the temperature decreased. It is also worth noting that though the ethoxylated amine (Ethomeen T15) exhibited reasonably good low temperature viscosity, the friction was significantly higher than any other sample.

TABLE 2

| 787 Fluid | | | | | | | |
|---|---|---|---|---|---|---|---|
| 787 Fluid | Tetrameen T | Triameen T | Duomeen T | Armolube 312 | Duomeen TDO | Armolube 211 | Ethomeen T15 |
| Friction | 0.189 | 0.178 | 0.168 | 0.16 | 0.156 | 0.16 | 0.198 |
| 40° C. Viscosity | 85.62 | 58.68 | 48.16 | 47.65 | 47.85 | 45.7 | 53.31 |
| 0° C. Viscosity | 279.72 | 261.3 | 221.06 | 205.63 | 206.7 | 194.04 | 264.91 |
| −20° C. Viscosity | 981.05 | 936.4 | 729.21 | 658.65 | 648.6 | 642.75 | 894.42 |

TABLE 3

| 690 Fluid | | | | | | | |
|---|---|---|---|---|---|---|---|
| 690 Fluid | Tetrameen T | Triameen T | Duomeen T | Armolube 312 | Duomeen TDO | Armolube 211 | Ethomeen T15 |
| Friction | 0.179 | 0.175 | 0.166 | 0.156 | 0.143 | 0.146 | 0.157 |
| 40° C. Viscosity | 65.76 | 63.72 | 58.78 | 56.86 | 55.35 | 54.33 | 57.14 |
| 0° C. Viscosity | 354.22 | 344.6 | 307.57 | 296.43 | 287.4 | 297.89 | 323 |
| −20° C. Viscosity | 1128 | 1118.8 | 972.29 | 881.13 | 865.6 | 877.75 | 1002.8 |

What is claimed is:

1. A magnetorheological fluid comprising magnetically responsive particles having an average particle diameter size of about 1 micrometers (μm) to 1000 μm, a carrier fluid, a friction reducing agent comprising an amine oleate salt that comprises at least one of a diamine dioleate or a triamine dioleate, an organoclay, micron or sub-micron sized molybdenum disulfide, and one or both of an organomolybdenum and a thiophosphorous compound.

2. A magnetorheological fluid consisting of magnetically responsive particles having an average particle diameter size of about 1.0 micrometers (μm) to 1000 μm, a carrier fluid, an amine salt of a carboxylic acid, an organoclay, one or both of an organomolybdenum and a thiophosphorous compound, and optionally micron or sub-micron sized molybdenum disulfide.

3. The fluid of claim 1, wherein an amine portion of the amine oleate salt comprises the structure:

$$CR_3—(CR_2)_x—CR_3,$$

wherein x is an integer between 0 and 10;

each R is independently selected from the group consisting of H, monovalent hydrocarbyl radicals and substituted counterparts thereof, $NH_2$ and $NHR^1$, wherein $R^1$ is selected from monovalent hydrocarbyl radicals and substituted counterparts thereof and wherein at least two of the R groups is selected from $NH_2$ and $NHR^1$.

4. The fluid of claim 3, wherein $R^1$ is selected from monovalent hydrocarbyl radicals and substituted counterparts thereof.

5. The fluid of claim 4, wherein $R^1$ comprises a tallow alkyl.

6. The fluid of claim 2, wherein the carboxylic acid comprises one carboxylic acid functionality and comprises about 10 to about 24 carbon atoms.

7. The fluid of claim 6, wherein the carboxylic acid comprises about 16-18 carbon atoms.

8. The fluid of claim 1, wherein the amine oleate salt comprises N-(tallowalkyl)-1,3,-propanediamine dioleate.

9. The fluid of claim 1, wherein the amine oleate salt is present in an amount from about 0.4 to about 0.6 percent by weight based upon the total weight of the magnetorheological fluid.

10. The fluid of claim 1, wherein the carrier fluid comprises at least one of mineral oil, paraffin oil, cycloparaffin oil, and synthetic hydrocarbon oil.

11. The fluid of claim 10, wherein the synthetic hydrocarbon fluid comprises a poly-α-olefin.

12. The fluid of claim 1, wherein the molybdenum disulfide has an average particle size of less than 2.0 microns.

13. The fluid of claim 12, wherein the average particle size of the molybdenum disulfide is about 1.5 microns or less.

14. The fluid of claim 1, wherein at −20° C. the viscosity is at least 75% less than the viscosity of an otherwise identical fluid without the amine oleate salt additive, wherein the viscosity is measured on an ARES-G2 rheometer with a 25 mm top plate and 40 mm bottom cup.

15. The fluid of claim 1, wherein the coefficient of friction is at least 50% of the coefficient of friction measured in an otherwise identical fluid without the amine oleate salt additive, wherein the friction is measured on an ARES-G2 rheometer with a "ball on three ball" configuration.

16. The fluid of claim 1, wherein the fluid is free of an organomolybdenum compound.

17. The fluid of claim 2, wherein the amine salt of a carboxylic acid is an amine oleate salt.

18. The fluid of claim 2, wherein the carrier fluid consists of magnetically responsive particles having an average particle diameter size of 1.0 μm to 1000 μm, a carrier fluid consisting of a poly-α-olefin and dioctyl sebacate, an amine oleate salt, an organomolybdenum additive, a thiophosphorous additive, and an organoclay.

* * * * *